United States Patent [19]

Lohner

[11] 4,209,329

[45] Jun. 24, 1980

[54] LOW SILVER COATING WEIGHT, HIGH SPEED FILMS HAVING TWO SIMILAR EMULSION LAYERS

[75] Inventor: Donald Lohner, Englishtown, N.J.

[73] Assignee: E. I. Du Pont de Nemours and Company, Wilmington, Del.

[21] Appl. No.: 929,773

[22] Filed: Jul. 31, 1978

Related U.S. Application Data

[63] Continuation-in-part of Ser. No. 792,707, May 2, 1977, abandoned.

[51] Int. Cl.[2] ..... G03C 1/76

[52] U.S. Cl. ..... 430/502; 430/566; 430/599; 430/631

[58] Field of Search ..... 96/68, 95, 114.5, 107

[56] References Cited

U.S. PATENT DOCUMENTS

| | | | |
|---|---|---|---|
| 746,594 | 12/1903 | Smith | 96/68 |
| 2,240,472 | 4/1941 | Swan | 96/114.5 |
| 2,400,532 | 5/1946 | Blake et al. | 96/114.5 |
| 2,423,549 | 7/1947 | Blake | 96/107 |
| 2,716,062 | 8/1955 | Carroll et al. | 96/107 |
| 3,142,568 | 7/1964 | Nottort | 96/114.5 |
| 3,325,286 | 6/1967 | Nottort | 96/114.5 |
| 3,516,844 | 6/1970 | Padday | 96/114.5 |
| 3,785,823 | 1/1974 | Bigelow | 96/107 |
| 3,846,135 | 11/1974 | Hellmig et al. | 96/68 |
| 3,888,676 | 6/1975 | Evans | 96/68 |
| 3,915,713 | 10/1975 | Shiba et al. | |
| 3,923,515 | 12/1975 | Van Stappen | 96/68 |
| 3,929,486 | 12/1975 | Habu et al. | 96/107 |

FOREIGN PATENT DOCUMENTS

| | | | |
|---|---|---|---|
| 51-125197 | 5/1976 | Japan | 96/68 |

*Primary Examiner*—J. Travis Brown

[57] ABSTRACT

The silver halide coating weight of a lithographic element can be reduced by ca. 40% by coating two layers of gelatino-silver halide emulsion on a support, and dividing a speed-adjusting polyoxyethylene compound unequally between the two layers.

10 Claims, No Drawings

LOW SILVER COATING WEIGHT, HIGH SPEED FILMS HAVING TWO SIMILAR EMULSION LAYERS

RELATION TO OTHER CASES

This is a continuation-in-part of Ser. No. 792,707 filed May 2, 1977, now abandoned.

BACKGROUND OF THE INVENTION

Graphic arts products such as lithographic films consist generally of a photographic silver halide emulsion in a hardened organic colloid binder coated on a suitable support, and serve for the production of half-tone dot images useful in letterpress printing, lithography and the like.

The silver halide emulsions commonly used in the graphic arts field, for example, silver bromochloride, are expensive mainly because of their silver content. The industry is constantly considering ways to reduce the amount of silver halide used. Unfortunately, under ordinary conditions, reduction of silver coating weight for the standard single layer emulsion structure decreases speed, reduces top density, and, in the case of lithographic films, degrades dot quality. One means of better utilizing silver to increase the efficiency of litho systems is to remove or decrease the adjuvant normally added to improve dot quality (the "dot adjuvant"), which increases the speed substantially. However, in the absence of the dot adjuvant, dot quality is unacceptable, aging stability is poor, and overdevelopment fog result. Conventionally, polyoxyethylene compounds are used as dot adjuvants, for example.

The main object of the present invention is to reduce the silver content of a lithographic film and at the same time increase its speed, without the disadvantages described above.

SUMMARY OF THE INVENTION

The coating weight of a supported silver halide emulsion, particularly as applied to a lithographic film element, is substantially reduced by coating two layers of the same emulsion such that the sum of the coating weights of the two layers is less than in a comparable litho element in which the emulsion is coated as a single layer; and further characterized in that the top layer contains a given amount of a polyoxyethylene compound and the bottom layer contains a lesser amount or none at all, the total amount of polyoxyethylene compound in this dual layer element being equivalent to the amount which would normally be contained in an element having a single layer and yet a higher, over-all coating weight. The polyoxyethylene compound has the formula:

$$RO(CH_2CH_2O)_nR_1$$

wherein R is hydrogen, an alkyl of 1 to 18 carbon atoms, an aryl of 6 to 12 carbon atoms, an alkylaryl of 7 to 18 carbon atoms, or an arylalkyl of 7 to 18 carbon atoms; $R_1$ is hydrogen or an alkyl of 1 to 3 carbon atoms; and n=6–2500.

DETAILED DESCRIPTION OF THE INVENTION

In a preferred embodiment of this invention, an aqueous gelatino-silver bromochloride, lithographic emulsion is sensitized and digested in a manner familiar to those skilled in the art. The emulsion is then split into two portions. To one portion is added a predetermined amount of a polyoxyethylene compound of the formula set forth above.

Assuming that this portion will be used as the top layer of the two-layer emulsion coating which is to be formed in accordance with the invention, a lesser amount of the polyoxyethylene compound will be added to the other portion of the emulsion which is destined to be the bottom layer. In one particular embodiment the bottom layer is coated on the support without the addition of any of the polyoxyethylene compound. Assuming that a total of 100 parts by weight of this compound is to be used for both emulsion layers, this should be divided in such a way that the bottom layer will contain from 0 to 40 parts by weight of the polyoxyethylene compound, and the top layer will contain 60 to 100 parts. The result is a photographic film having two similar emulsion layers except that the bottom layer will have a higher speed than the top layer.

After the two coatings have been applied to the support, it is preferable to apply a hardened gelatin overcoat layer, after which the composite coating is dried, exposed sensitometrically through a neutral density wedge, processed by developing, fixing, etc., and the image densities can then be read on a conventional type of densitometer.

While a number of polyoxyethylene compounds are embraced within the formula set forth above, the one which is preferred is the condensation product of a polyethylene oxide with a $C_{12}$ unsaturated alcohol, which ordinarily acts as a restrainer in the standard single-layer emulsion structure.

The silver halide emulsions which may be used to practice the invention include all of the common silver halide types used, for example, in graphic arts, medical and industrial x-ray, cine negative or positives, and color films. These aqueous silver halide emulsions, for example, silver chloride, bromide, chlorobromide, bromoiodide, chloroiodide, or mixtures of chlorideiodidebromide emulsions usually contain gelatin and/or other polymer binders, such as dispersed aqueous polyethyl acrylate, and are preferably brought to their optimum sensitization by digestion with sulfur and gold in a known manner. The additives of this invention are added to the emulsion prior to coating it on a support, preferably on a film base.

The invention is not, however, limited to the use of a particular film base support, as the emulsions may be coated on various films and plates composed of glass, aluminum, various waterproof papers, cellulose derivatives, e.g., cellulose acetate; and superpolymers, e.g. polyethylene terephthalates, polycarbonates, polyethylene terephthalate/isophthalate, etc.

Of course, various sublayers may be present to anchor the emulsion to the base as is common in photographic film and plate manufacture. A suitable example is the vinylidene chloride copolymer coated supports of Alles et al. U.S. Pat. No. 2,627,088. Also, various other auxiliary layers may be employed such as antiabrasion layers and antihalation backing or undercoat layers.

The emulsions may be modified by the addition of general emulsion sensitizers, e.g., sodium thiosulfate; metal compounds, e.g. gold, platinum, palladium, iridium, rhodium, etc.; antifogging agents, e.g. 2-mercaptobenzothiazole; sensitizing dyes; hardeners, e.g. formaldehyde and other aliphatic aldehydes; and other emulsion adjuvants.

The present invention is particularly useful in lithographic photographic films possessing improved physical properties and improved edge sharpness of half-tone dots, as well as improved development and exposure latitude.

This new technique of unequally distributing the polyoxyethylene compound in two emulsion layers versus an equal distribution in one emulsion layer permits up to 40% reduction of silver halide coating weight without sacrifice of other properties. The slower speed, top emulsion layer appears to control dot quality whereas the higher speed bottom emulsion layer supplies additional top density for the multilayer structure.

Advantages of this invention are: (1) reduction in mill cost; (2) faster speeds and (3) lower overdevelopment fog, thereby increasing the film shelf-life. These advantages are achieved essentially without a sacrifice in sensitometric or other physical properties of the lithographic films.

EXAMPLE 1

A lithographic gelatino-silver halide emulsion comprising about 70 mole percent silver chloride and about 30 mole percent silver bromide, with silver halide grain sizes about 0.3 micron in diameter, was prepared. The manner of preparation was conventional and well known to those skilled in the art. The emulsion was prepared with about 65 g of gelatin per 1.5 mole of silver halide and was brought to its optimum sensitivity by the addition of gold and sulfur and digestion at an elevated temperature in the presence of these compounds. A panchromatic optical sensitizing dye was also added as were the usual wetting agents, coating aids, hardeners, antifoggants, etc. At this point, the emulsion was split into two portions, Portion 1 (the Control), and Portion 2.

To Portion 1 there was added 2 g of a polyethylene oxide condensation product prepared by condensing polyethylene oxide with a $C_{12}$ unsaturated alcohol, per 1.5 moles of silver halide. Portion 1 was then coated on a conventional polyester film support that had both a conventional resin sub and a gelatin sub coated thereon. One side of this support had a dye antihalation layer coated on the gel sub layer. The emulsion was coated on the side opposite to that having the antihalation layer at a coating weight of about 110 mg/dm$^2$, calculated as silver bromide, and a gelatin overcoat was applied thereon at about 11 mg/dm$^2$.

Portion 2 was further split into two portions. The polyethylene oxide condensation product described above was added to one half of Portion 2 at the same level of concentration as in the Control. The other half of Portion 2, which did not contain the polyethylene oxide condensation product, was coated on another polyester film support similar to that described above, at a coating weight of about 40 mg/dm$^2$, calculated as silver bromide. The half of Portion 2 which did contain the polyethylene oxide condensation product was then coated upon this layer at a coating weight of about 25 mg/dm$^2$, calculated as silver bromide. A gelatin overcoat layer was then coated on top of this emulsion layer at a coating weight of about 11 mg/dm$^2$.

The two film products compared as follows:

| Products | Support | Overcoat | Layers Silver Halide Emulsion | Coating Weight |
|---|---|---|---|---|
| (1) Control | Polyester | Gelatin | 1 | 110 mg/dm$^2$ |
| (2) Of this Invention | Polyester | Gelatin | 2 | 65 mg/dm$^2$ |

After these films had been coated they were dried in a conventional manner. Sample film strips were cut from each and given a standard exposure through a grey half-tone screen and a $\sqrt{2}$ step wedge. The exposed strips were processed in an automatic processor (LogE) with a 1¾ minute development time. The processor contained a conventional lithographic developer (based on hydroquinone developing agent and formaldehyde bisulfite). The fixer was also conventional. The strips were also washed and dried in the processor. The following sensitometric results were obtained:

| Sample | Base Plus Fog | Relative Blue Speed | Dot Quality[1] 10% | 50% | 90% |
|---|---|---|---|---|---|
| Control | .07 | 100 | 3 | 2 | 3 |
| Of this Invention | .06 | 117 | 3 | 2 | 3 |

[1]where 1 is excellent and 5 is poor.

From this data, the film prepared according to the teachings of this invention was equivalent in every way to the Control at about 41% less coating weight, representing a very substantial savings in silver.

EXAMPLE 2

An emulsion similar to that described in Example 1 was prepared in duplicate. Samples were prepared as described therein except that 2.4 g of the polyethylene oxide condensation product per 1.5 mole of silver halide was used. The Control was again coated as one layer at a thickness of 110 mg/dm$^2$, calculated as silver bromide. The sample representing this invention was prepared again as two contiguous layers. The layer nearest the support contained no polyethylene oxide condensation product and was coated at a coating weight of 20 mg/dm$^2$, calculated as silver bromide. The second layer, which contained 2.4 g of the polyethylene oxide condensation product per 1.5 moles of silver bromide, was coated at a coating weight of 50 mg/dm$^2$, calculated as silver bromide. Both samples had a gelatin overcoat applied thereon at a coating weight of about 11 mg/dm$^2$. Sample strips from each dried coating were exposed and developed as described in Example 1 with the following results:

| Sample | Base Plus Fog | Relative Speed Blue | Dot Quality 10% | 50% | 90% |
|---|---|---|---|---|---|
| Control | .06 | 133 | 4 | 3 | 4 |
| Of this Invention | .05 | 178 | 4 | 3 | 4 |

EXAMPLES 3-6

In these Examples the emulsion was identical to that described in Example 2. The Control was also as described therein. Samples illustrating this invention were prepared from dual layer coatings of the same emulsion with the coating weights varied as shown below. In each case, the amount of polyethylene oxide condensation product was the same as Example 2 and was added to the top layer. In one case (Example 6), one third of the condensation product was added to the bottom layer. Hence, Example 6 demonstrates the use of 66⅔% of polyethylene oxide condensation product in the top layer and 33⅓% in the bottom layer. Sample strips from each dried coating were exposed and developed as previously described with the following results:

| Sample | Coating Weight (mg/dm²) Bottom Layer | Upper Layer | Base + Fog | Relative Speed Blue | Dot Quality 10% | 50% | 90% |
|---|---|---|---|---|---|---|---|
| Control | 110 - single layer | | .06 | 133 | 4 | 3 | 4 |
| Example 3 | 30 | 40 | .07 | 168 | 3 | 3 | 4 |
| Example 4 | 40 | 30 | .05 | 180 | 3.5 | 3 | 4 |
| Example 5 | 50 | 20 | .06 | 128 | 3 | 3 | 4 |
| Example 6 | 20 | 50 | .06 | 163 | 3.5 | 3 | 4 |

EXAMPLE 7

An emulsion very similar to that described in Example 1 was prepared. This emulsion was prepared so as to yield a larger grain size distribution (about 0.2 to 0.7 micron). The ratio of chloride to bromide was about 70/30 mole percent with about 200 g of gelatin per 1.5 moles of silver halide. This emulsion, too, was sensitized to its optimum sensitization by digestion at elevated temperatures with gold and sulfur compounds as well known to those skilled in the art. The usual wetting agents, coating aids, hardeners, antifoggants, etc. were added. The emulsion was also sensitized with an orthochromatic sensitizing dye. The emulsion was split into two portions. To Portion 1, the Control, was added 0.6 g/1.5 moles of silver halide, of a compound of the formula

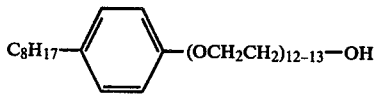

Portion 2, representing this invention, was subdivided. One portion was coated on a support similar to that described in Example 1 at a coating weight of 10 mg/dm², calculated as silver bromide, without further treatment. The other portion, after admixture with the same compound as that described above for Portion 1 and at the same concentration level, was applied as a second coat at a coating weight of about 50 mg/dm², calculated as silver bromide. The Control was coated at a coating weight of about 90 mg/dm². Both samples were overcoated with a gelatin layer at a coating weight of about 11 mg/dm². The structures achieved in this Example compared as follows:

| Product | Support | Over-coat | Layers Silver Halide | Coating Weight |
|---|---|---|---|---|
| Control | Polyester | Gelatin | 1 | 90 |
| Of this Invention | Polyester | Gelatin | 2 | 60 |

Sample strips from each dried coating were exposed and processed as described in the previous Examples with the following sensitometric results:

| Sample | Base Plus Fog | Relative Speed Half-tone | Cont. Tone | Grad. | Den-sity | Dot Quality 10% | 50% | 90% |
|---|---|---|---|---|---|---|---|---|
| Control | .03 | 100 | 100 | 6.7 | 4.84 | 3 | 3.5 | 3.5 |
| Of this Invention | .03 | 100 | 107 | 7.8 | 4.48 | 2 | 2 | 3 |

This Example demonstrates that when the teachings of this invention are practiced, one can lower the coating weight by about 33% and yet achieve practically the same results sensitometrically. The sample demonstrating this invention, above, had equivalent speeds to the Control, better gradient, and better dot quality while showing only a slight reduction in top density compared to the Control.

EXAMPLE 8

An emulsion identical to that described in Example 2 was prepared and coated. Sample strips from these coatings were exposed and developed at 1½ min. fresh, and after aging for 5 months, with the following results:

| Sample | Fresh Base + Fog | Rel.Blue Speed | O.D. Fog(1) | Aged Base + Fog | Rel.Blue Speed | O.D. Fog(1) |
|---|---|---|---|---|---|---|
| Control | 0.04 | 100 | .59 | .08 | 90 | 1.37 |
| Of this Invention | .05 | 119 | .56 | .07 | 132 | .74 |

(1)O.D. - OVERDEVELOPMENT (Sample developed 3 min. in same developer).

This example demonstrates that the dual layer element of this invention exhibits better shelf life stability.

EXAMPLE 9

An emulsion identical to that described in Example 7 was prepared, sensitized and further treated as described therein. The emulsion was split into 2 portions. To Portion 1, the Control, was added 4.2 g/1.5 moles of silver halide of the polyethylene oxide (PEO) compound described in Example 7, in the form of a 10% aqueous solution. Portion 1 was then coated at a coating weight of about 90 mg/dm², calculated as silver bromide, on a support identical to that described in Example 1. A gelatin overcoat was applied contiguous thereto at a coating weight of about 10 mg/dm² (calculated as gelatin).

Portion 2 was further split into two portions. One-half of Portion 2 was mixed with 0.7 g/1.5 moles of silver halide of the same PEO compound and then coated (Layer 1) at a coating weight of about 20 mg/dm$^2$ (calculated as silver bromide). The second half of Portion 2 was mixed with 3.5 g/1.5 moles of silver halide of the same PEO compound and then coated (Layer 2) contiguous to Layer 1 at a coating weight of about 50 mg/dm$^2$ (calculated as silver bromide). An abrasion layer (about 10 mg/dm$^2$, calculated as gelatin) was then coated on top of Layer 2.

The coated films from each portion were dried and film strips were cut from each. These strips were exposed and processed as described in Example 7. The following sensitometric results were obtained:

| Sample | Base Plus Fog | Rel Speed | Gradient | Remarks |
|---|---|---|---|---|
| Control | 0.04 | 100 | 7.79 | Actual coat. wt. = 95 mg/dm$^2$ |
| Of this Invention | 0.04 | 242 | 13.94 | Actual coat. wt. (total for both layers) = 78 mg/dm$^2$ |

Additional sample strips from these coatings were permitted to age for two weeks. These strips were then exposed and developed as described above and the following sensitometric results were obtained:

| Sample | Base Plus Fog | Rel Speed | Gradient | Dot Quality(1) 10% | 50% | 90% |
|---|---|---|---|---|---|---|
| Control | 0.04 | 100 | 10.08 | 2.0 | 1.5 | — |
| Of this Invention | 0.04 | 275 | 9.37 | 2.0 | 1.5 | 2.0 |

This example demonstrates an actual 18% reduction in overall coating weight when the PEO is split between the two layers (83% in the top and 17% in the bottom. The sensitometric properties are equivalent, if not slightly better than, the single layer control.

EXAMPLE 10

This example was a duplicate of Example 9 except for the amount of PEO used. In the Control, 4.9 g/1.5 moles of silver halide of PEO was added and the emulsion coated at about 90 mg/dm$^2$ as silver bromide. The sample which represents this invention was split into two halves. The first half was mixed with 1.4 g/1.5 moles of silver halide of PEO and coated at about 20 mg/dm$^2$ as silver bromide. The second half was mixed with 3.5 g/1.5 moles of silver halide and coated contiguous to the first half coating at a coating weight of about 50 mg/dm$^2$ as silver bromide. Gelatin overcoats (10 mg/dm$^2$) were applied to each coating and, after drying, samples were cut from each and exposed and developed as described in Example 1. The sensitometric results were as follows:

| Sample | Base Plus Fog | Rel Speed | Gradient | Remarks |
|---|---|---|---|---|
| Control | 0.05 | 100 | 7.41 | Single layer |
| Of this Invention | 0.05 | 75 | 10.55 | Dual Layer (72% PEO in upper, 28% PEO in lower) - 1 week old |

Sample strips were then allowed to age for two weeks. These strips were then exposed and developed as previously described with the following results:

| Sample | Base Plus Fog | Rel Speed | Gradient | Dot Quality 10% | 50% | 90% |
|---|---|---|---|---|---|---|
| Control | 0.05 | 100 | 8.57 | 2.5 | 1.5 | 2 |
| Of this Invention | 0.05 | 186 | 11.35 | 2.5 | 1.5 | 2.5 |

This example demonstrates a preferred embodiment of this invention, in which a total coating weight of 70 mg/dm$^2$ of silver bromide according to the invention (50 mg/dm$^2$ in the upper layer and 20 mg/dm$^2$ in the lower layer), is compared to using 90 mg/dm$^2$ of silver bromide as a single layer. This is more than a 22% reduction in weight. Yet the sensitometric value of the dual layer element of this invention is as good, if not better than, the single layer element.

I claim:

1. A photographic film comprising a support and a photosensitive gelatino-silver halide emulsion layer on said support, characterized in that two layers of the same emulsion are coated on the support, and a dot adjuvant consisting of a polyoxyethylene compound is divided between the layers in such a way that 60–100% of the polyoxyethylene compound is in the top layer and 40–0% thereof is in the bottom layer; said polyoxyethylene compound having the formula $$RO(CH_2CH_2O)_nR_1$$

wherein R is either hydrogen, a $C_1$–$C_{18}$ alkyl group, a $C_6$–$C_{12}$ aryl group, a $C_7$–$C_{18}$ alkylaryl group, or a $C_7$–$C_{18}$ arylalkyl group; $R_1$ is hydrogen or a $C_1$–$C_3$ alkyl group; and n=6–2500.

2. The photographic film of claim 1 wherein the polyoxyethylene compound is a condensation product of a polyethylene oxide and a $C_{12}$ unsaturated alcohol.

3. In a lithographic film having a photosensitive gelatino-silver halide emulsion layer on a polyester support, the improvement wherein the gelatino-silver halide emulsion layer is divided into two layers, a bottom layer adjacent to the support, which layer may or may not contain a dot adjuvant consisting of a polyoxyethylene compound, and a top layer of the same composition except that it contains a finite amount of said polyoxyethylene compound, which amount is in excess of that which is present in the bottom layer, the ratio being such that 60–100% of the polyoxyethylene compound is in the top layer and 0–40% is in the bottom layer wherein said polyoxyethylene has the formula:

$$RO(CH_2CH_2O)_nR_1$$

wherein R is either hydrogen, a $C_1$–$C_{18}$ alkyl group, a $C_6$–$C_{12}$ aryl group, a $C_7$–$C_{18}$ alkylaryl group, or a $C_7$–$C_{18}$ arylalkyl group; $R_1$ is hydrogen or a $C_1$–$C_3$ alkyl group; and n=6–2500.

4. The lithographic film of claim 3 wherein a major amount of the polyoxyethylene compound is in the top layer and a lesser amount is in the bottom layer.

5. The lithographic film of claim 3 wherein $\frac{2}{3}$ of the polyoxyethylene compound is in the top layer and the other $\frac{1}{3}$ is in the bottom layer.

6. The lithographic film of claim 3 wherein 72% of the polyoxyethylene compound is in the top layer and the other 28% is in the bottom layer.

7. The lithographic film of claim 3 wherein 83% of the polyoxyethylene compound is in the top layer and the other 17% is in the bottom layer.

8. In a process for the preparation of a lithographic film having a photosensitive silver halide emulsion layer on a polyester support, the improvement comprising coating the polyester support with two successive layers of a polyoxyethylene-containing gelatino-silver halide emulsion, the composition of the two layers being the same except that a greater amount of the polyoxyethylene compound is in the top layer than in the bottom layer adjacent the support, followed by applying a gelatin overcoat layer and drying the composite coatings, with the result that up to a 40% reduction of silver halide coating weight is achieved wherein said polyoxyethylene has the formula:

$$RO(CH_2CH_2O)_nR_1$$

wherein R is either hydrogen, a $C_1$–$C_{18}$ alkyl group, a $C_6$–$C_{12}$ aryl group, a $C_7$–$C_{18}$ alkylaryl group, or a $C_7$–$C_{18}$ arylalkyl group; $R_1$ is hydrogen or a $C_1$–$C_3$ alkyl group; and n=6–2500.

9. The process of claim 8 wherein the polyoxyethylene compound is distributed between the said two layers in such a way that a major amount is in the top layer and a lesser amount is in the bottom layer.

10. A lithographic film prepared by the process of claim 8.

* * * * *